US006331148B1

(12) United States Patent
Krause et al.

(10) Patent No.: US 6,331,148 B1
(45) Date of Patent: Dec. 18, 2001

(54) CASINO/LOTTERY/SPORTS STYLED WAGERS AND GAMES FOR PARIMUTUEL OPERATION

(76) Inventors: Lawrence Alan Krause; Kenneth Alan Scott, both of P.O. Box 210095, Milwaukee, WI (US) 53221

( * ) Notice: Subject to any disclaimer, the term of this patent is extended or adjusted under 35 U.S.C. 154(b) by 0 days.

(21) Appl. No.: 09/267,865

(22) Filed: Mar. 12, 1999

(51) Int. Cl.[7] ..... A63F 9/22
(52) U.S. Cl. ..... 473/274; 463/16
(58) Field of Search ..... 273/259, 274, 273/139; 463/6, 16, 28

(56) References Cited

U.S. PATENT DOCUMENTS

| | | | | |
|---|---|---|---|---|
| Re. 35,864 | | 7/1998 | Weingardt | 463/28 |
| 3,505,646 | | 4/1970 | Affel, Jr. et al. | 340/172.5 |
| 4,288,077 | | 9/1981 | Rose et al. | 273/246 |
| 4,540,174 | * | 9/1985 | Coppock . | |
| 4,842,278 | | 6/1989 | Markowicz | 273/138 |
| 4,962,950 | | 10/1990 | Champion | 283/67 |
| 5,048,833 | | 9/1991 | Lamie | 273/138 |
| 5,106,089 | | 4/1992 | Wood | 273/139 |
| 5,129,652 | | 7/1992 | Wilkinson | 273/139 |
| 5,265,877 | | 11/1993 | Boylan et al. | 273/139 |
| 5,374,060 | | 12/1994 | Goldberg | 273/138 |
| 5,476,259 | | 12/1995 | Weingardt | 273/85 |
| 5,518,239 | | 5/1996 | Johnston | 273/139 |
| 5,540,442 | | 7/1996 | Orselli et al. | 463/17 |
| 5,560,603 | | 10/1996 | Seelig et al. | 463/6 |
| 5,613,679 | | 3/1997 | Casa et al. | 273/138.1 |
| 5,669,606 | | 9/1997 | Brown | 273/274 |
| 5,687,968 | | 11/1997 | Tarantino | 273/139 |
| 5,695,192 | | 12/1997 | Brown | 273/274 |
| 5,728,002 | | 3/1998 | Hobert | 463/17 |
| 5,743,525 | | 4/1998 | Haddad | 273/139 |
| 5,743,798 | | 4/1998 | Adams et al. | 463/17 |
| 5,755,440 | | 5/1998 | Sher | 273/142 |
| 5,758,878 | | 6/1998 | Brown | 273/274 |
| 5,762,552 | | 6/1998 | Vuong et al. | 463/25 |
| 5,769,714 | | 6/1998 | Wiener et al. | 463/3 |
| 5,779,547 | | 7/1998 | SoRelle et al. | 463/28 |
| 5,782,470 | * | 7/1998 | Langan . | |
| 5,782,472 | | 7/1998 | Brown | 273/274 |
| 5,788,240 | | 8/1998 | Feinberg | 273/274 |
| 5,795,226 | | 8/1998 | Yi | 463/22 |
| 5,800,263 | | 9/1998 | Hayashida et al. | 463/6 |
| 5,810,360 | | 9/1998 | Srichayaporn | 273/292 |
| 5,816,575 | | 10/1998 | Keller | 273/292 |
| 5,823,536 | | 10/1998 | Flasch | 273/292 |
| 5,823,872 | * | 10/1998 | Prather et al. . | |
| 5,823,879 | | 10/1998 | Goldberg et al. | 463/42 |
| 5,836,816 | * | 11/1998 | Bruin et al. . | |
| 5,848,936 | | 12/1998 | Morrison | 463/17 |
| 5,888,136 | | 3/1999 | Herbert | 463/22 |
| 5,957,775 | * | 9/1999 | Cherry . | |

* cited by examiner

*Primary Examiner*—William M. Pierce
(74) *Attorney, Agent, or Firm*—Boyle Fredrickson Newholm Stein & Gratz S.C.

(57) ABSTRACT

A method of application of popular casino, lottery, and sports games formatted and modified specifically for the parimutuel race industry. The invention games possess unique rules and formats to govern their play within parimutuel race wagering while reflecting existing games from casinos, lotteries and sports. Wagers are placed electronically with parimutuel race operators who retain a percentage of all bets as determined by individual state law. Outcomes of the invention games are determined by their unique rules and interpretation of current parimutuel racing results.

20 Claims, 5 Drawing Sheets

CASINO/LOTTERY/SPORTS STYLED WAGERS AND GAMES FOR PARIMUTUEL OPERATION

BACKGROUND

1. Field of Invention

This invention relates to amusements and games, specifically to the methods of operation of parimutuel racing industry.

2. Description of Prior Art

Parimutuel racing operators are facing increased competition daily. The expansion of casino gambling and the pervasiveness of state run lotteries are hurting the industry. All compete for the public's valuable discretionary dollars. Trends indicate current parimutuel racing operators are losing significant market share.

Current parimutuel race gaming is at a distinct disadvantage to its competition. To win consistently, a player must develop expertise in dog/horse selection or handicapping. In every parimutuel race, hundreds of factors must be evaluated to select or handicap the winning animal(s). Upon handicapping the animals, hundreds of different wagering combinations are then available. Accordingly, acquiring expertise in handicapping and correct wagering selection is a laborious and expensive process. The general public is Intimidated. When a novice does come in to wager, they almost always lose money. They rarely come back as repeat wagerers.

However, little expertise is needed to play a slot machine or scratch a lottery ticket. The general public always gravitates towards the easiest option. Therefore, parimutuel racing operators have seen their "handles" (the amount of wagering per night) decrease across the country.

Casinos and lotteries are wildly popular due to their ease of play and availability. Their games including blackjack, roulette, craps, slots, various pick-a-number(s), and scratch tickets are well known and heavily played.

Parimutuel race wagering has seen a decline in playership due to intense competition and inherent difficulty of play. The handicapping process is intimidating especially for novices. Parimutuel race wagering options including win, place, show, quinelas, daily doubles, quinela doubles, perfectas, trifectas, superfectas, twin trifectas, and tri-supers are complicated and difficult Unfortunately, the parimutuel race industry has seemed oblivious to its own shortcomings. Their games are based on the arduous requirements of animal handicapping. Their basic wagering options have remained static for decades. The parimutuel race industry is not user friendly. The goal of the invention package games is to make the parimutuel race industry user friendly.

Many methods of games and gaming have been patented in each of the areas involved with the invention. Those areas are parimutuel wagering, blackjack, roulette, craps, lottery, baseball, and combinations of different forms of gambling. However, this prior art does not accomplish the goal of the invention package games.

The area of parimutuel wagering has been issued several patents. For example, U.S. Pat. No. 5,374,060 (1993) is a method for wagering at a racetrack This patent relates directly to the static parimutuel race wagering options of win and/or place and/or show and incorporates no other influences from other forms of gaming. U.S. Pat. No. 5,779,547 (1997) Is a parimutuel gaming system that requires the establishment of player accounts. This system is unspecific to the games with which it works and offers no new methods for wagering. U.S. Pat. No. 5,476,259 (1993) is a method of playing a live casino table game that combines multiple games with a portion of all wagers going into a parimutuel pool. Individual game rules are not altered. None of the games offered are parimutuel race games or wagers. U.S. Pat. No. 5,795,226 (1996) is a method of playing a betting race game that requires dice and game pieces and is not applicable to the parimutuel race Industry. U.S. Pat. No. 3,505,646 is an automatic parimutuel wagering system requiring an electronic device. It offers only current parimutuel race wagers. It does not incorporate influences from any other game or alter any method of wagering.

The area regarding blackjack has received numerous patents. For example(s): U.S. Pat. No. 5,823,879 (1998); U.S. Pat. No. 5,823,536 (1998); U.S. Pat. No. 5,816,575 (1998); U.S. Pat. No. 5,810,360 (1998); plus 70 others. These patents apply to blackjack as a card game whether in method of play, as a piece of hardware, or with a game board. These patents do not reformat the game of blackjack for use in the parimutuel race industry.

The area regarding roulette has received numerous patents. For example(s): U.S. Pat. No. 5,755,440 (1998); U.S. Pat. No. 5,743,798 (1998); U.S. Pat. No. 5,540,442 (1996); plus over 50 others. These patents relate to various apparatus for playing roulette, gaming machines, and methods for enhanced roulette styled games. These patents do not reformat the game of roulette for use in the parimutuel race industry.

The area regarding craps has received numerous patents. For example: U.S. Pat. No. 5,728,002 (1998); U.S. Pat. No. 5,788,240 (1998); U.S. Pat. No. 5,823,879 (1998); U.S. Pat. No. 5,762,552 (1998); plus 20 others. These patents relate to methods for playing an enhanced craps styled game; combinations of craps with different games other than parimutuel race wagering; apparatus for playing craps; and networked gaming systems offering craps and other games for play other than parimutuel race wagering. These patents do not reformat the game of craps for use in the parimutuel race industry.

The area regarding lotteries has received numerous patents. Approximately 270 patents have been issued relating to many forms of apparatus, forms of tickets, ticket scrapers, methods, video gaming, number selectors, etc. These patents do not reformat lotteries for use in the parimutuel race industry. More importantly, lotteries function on the basis of a random number generator to produce their results. A player of the invention package game in a lottery format has the advantage of using his handicapping skills to improve the odds over random number generation. Additionally in any given race, certain animals have advantages over the other animals. The combination of the player and animal factors make the number generation in the invention package game clearly non-random and differentiates it from the existing prior art.

The area regarding baseball has received numerous patents. Approximately 858 patents have been issued relating to equipment for play, board and simulated games, and many other apparatus. U.S. Pat. No. 5,769,714 (1996) is a method and apparatus for playing a baseball gambling game on an electrical device. This patent does not reformat the game of baseball for use in the parimutuel race industry.

The area regarding combinations of different forms of gaming has received numerous patents. For example: U.S. Pat. No. 5,788,240 (1997) is a method for combining keno and craps. This patent requires both dice and a game board, allows wagers on all possible combinations, and does not establish an ongoing betting pool; U.S. Pat. No. 5,782,472 (1998) is a combination of a game of chance and craps requiring cards, dice, and a game board. It is not applicable to parimutuel race wagering; U.S. Pat. No. 5,758,878 (1998) is a combination of baccarat and craps requiring cards, dice and a game board. It is not applicable to parimutuel race wagering; U.S. Pat. No. 5,695,192 (1997) is a method of craps qualified by blackjack requiring requiring cards, dice and a game board. It is not applicable to parimutuel race wagering; U.S. Pat. No. 5,669,606 (1997) is a method of craps qualified by baccarat requiring cards, dice and a game board. It is not applicable to parimutuel race wagering; U.S. Pat. No. 4,288,077 (1980) Is a horse race lottery game requiring game pieces, random drawings by players, and a game board and is not applicable to the parimutuel race industry; U.S. Pat. No. 5,518,239 (1994) Is a lottery racing sweepstakes based upon generating and assigning random numbers to players upon payment with winning determined by comparing race results to the assigned numbers. There is no selection of numbers by players; and U.S. Pat. No. 5,560,603 (1996) is a combined slot machine and racing game requiring slot machines, a display of some racing element driven by slot results, and a display of the racing activity of the elements. It is not applicable to the parimutuel race industry.

Therefore, the precedent exists for issuing patents on combinations of different forms of gaming. However, the combination of the invention package games to the parimutuel race industry has no precedent or infringement on existing prior art.

OBJECTS AND ADVANTAGES

Accordingly, several objects and advantages of our invention are:

(a) to provide new methods of wagering for parimutuel race operators to combat fierce competition;

(b) to provide the public new and exciting methods to enjoy parimutuel race wagering without the requirement of expertise in dog or horse selection;

(c) to provide new applications of popular games to an industry locked into its own set of static, difficult, and ancient wagering options;

(d) to provide these new gaming methods to parimutuel race operators without altering the physical nature of the running the races in their form of racing;

(e) to provide unique game rules to offer these additional wagering options to the public;

(f) to provide a formula for payouts from comparing said rules to current parimutuel racing results;

(g) to provide games that are profitable for players and operators;

(h) to provide a means for parimutuel race operators to encourage repeat business.

Further objects and advantages of our invention will become apparent from a consideration of the ensuing descriptions.

SUMMARY

Our invention is a new method of application of popular casino, lottery, and sports games specifically formatted for the parimutuel race industry (dog and horses). Our invention uniquely interprets results of parimutuel racing to work within our gaming formats and rules. These easy-to-understand games will be enjoyable for even the novice player. These games will encourage repeat business with increased wagering for the parimutuel industry. These games will be easily implemented by and hugely profitable for parimutuel race operators.

DESCRIPTIONS

The following comprises the working components of our method. This invention game package will offered to parimutuel race operators:

(a) BLACKJACK FAST OR LAST

Players choose whether the total of the starting numbers of the first four finishing animals or the starting numbers of the last four finishing animals will total closer to 21 without going over. Busts (totals over 21) lose. Ties push and rollover to the next race. Scratches (animals pulled from the race prior to running) are automatically in the LAST category.

(b) ROUF-LETTE

Players may wager upon whether the first place finishing animal's starting number is high or low, odd or even, or whether the first place finishing animal is male or female. Compounded wagers (ex. high, even, male) will also be accepted at a higher buy-in with subsequent higher pay-off.

(c) BASEBALL

Players bet on either the home team (even numbered animals) or the away team (odd numbered animals). The finishing position of each animal equals the number of "runs" scored by that animal. The team with the highest number of runs wins.

(d) DOGGIE CRAPS or HORSIE CRAPS

Players choose either the number "7" or "11". Winners are determined by the total of the starting numbers of the first and second place finishing animals. If that total equals either "7" or "11", players holding tickets for that number win. If that total does not equal "7" or "11", the betting pool carries over to the next race. This continues until "7" or "11" is reached exactly. Winning pairs for "7" include: 1 and 6; 2 and 5; 3 and 4. Winning pairs for "11" for dogs include: 3 and 8; 4 and 7; 5 and 6. Winning pairs for "11" for horses include: 1 and 10; 2 and 9; 3 and 8; 4 and 7; 5 and 6.

(e) POWERDOG or POWERSTEED

Players attempt to choose the winning animal in the last several races of a racing program, comprising the POWERDOG/POWERSTEED bracket. The winning animal in the last race is the POWERDOG or POWERSTEED. Payouts increase with the number of correct selections within the bracket by the player. Payouts increase further if the correct animal is selected as the POWERDOG or POWERSTEED. Any player correctly selecting all winners within the bracket wins the jackpot or splits with multiple winners. If no player correctly selects all the winners in the bracket, the jackpot portion of the betting pool carries over to the next day's racing program. Players with some but not all winning selections in the bracket are paid a set percentage of the betting pool that corresponds to their number of winning selections.

BRIEF DESCRIPTION OF THE DRAWINGS

The drawings furnished herewith illustrate a preferred methodology of the present invention in which the above advantages and features are clearly disclosed as well as others which will be readily understood from the following description of the illustrated embodiments.

In the drawings.

OPERATIONS

The manner of use of our invention is two fold between the parimutuel race operators and the player of the game.

Parimutuel racing operations offer their current games at betting windows. These windows are on site or OTB (off track betting). Each window Is controlled by a teller on an electronic betting machine. The electronic betting machines are programmed with the types of wagers available to patrons.

Parimutuel race operators, upon licensing, will modify their operating system software to run the invention package games. Betting window tellers will take wagers from the public on all games offered. These games will include the standard parimutuel race wagers and the invention package games. Pay-outs in the invention package games are determined by each game's unique interpretation of the finishing order of the animals.

Absolutely no alteration of the physical running of the race is required. Traditionally and in most cases by law, the minimum bet on any wager is $2.00 (US). Parimutuel race operators retain a percentage of all bets placed as an operating fee with levels determined by individual state law.

The parimutuel player has many options when placing wagers electronically with the betting window tellers. The player's new options with the invention package games are described in a game-by-game basis in the following:

(a) BLACKJACK FAST OR LAST

Figure 1:
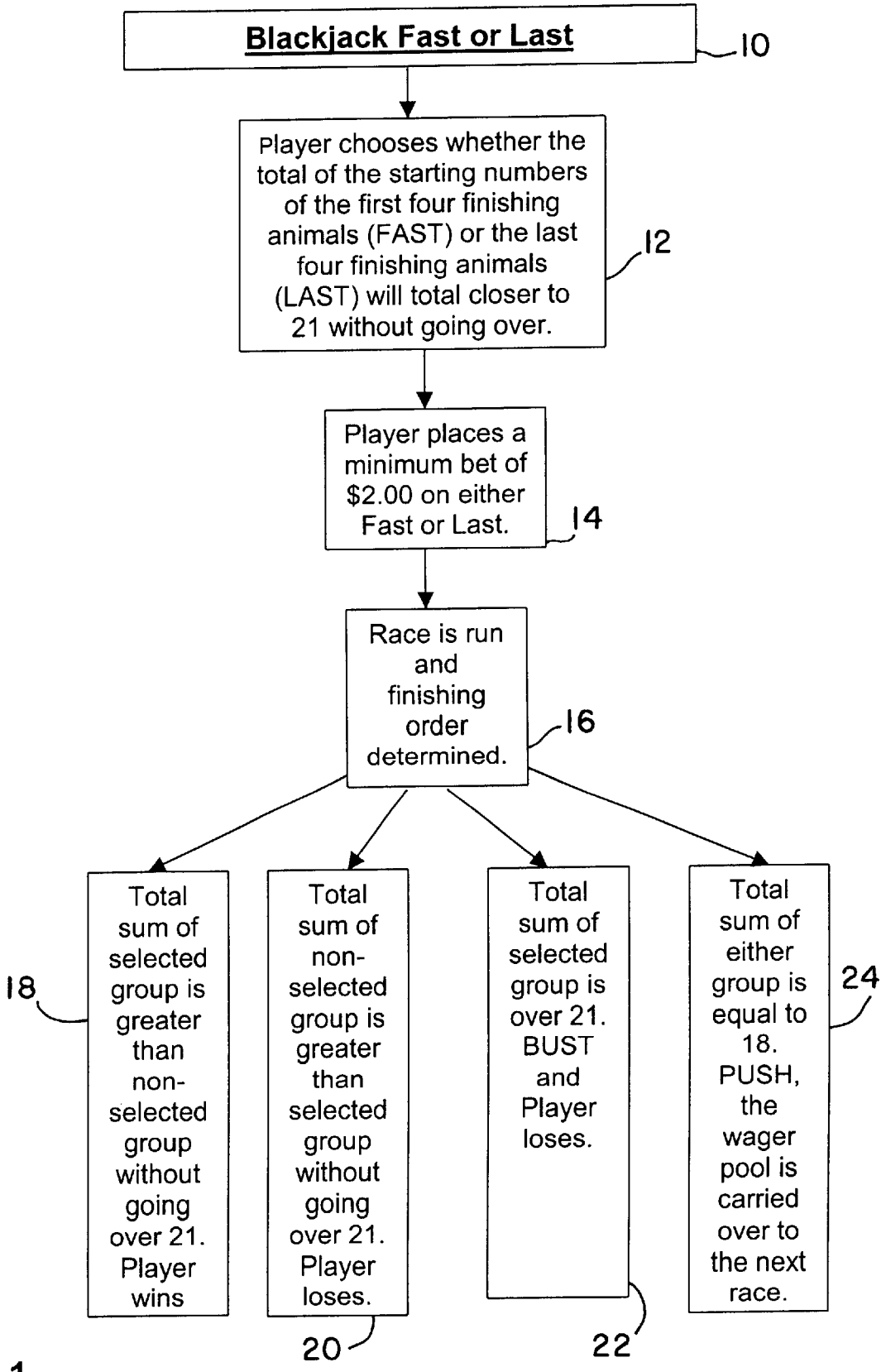
FIG. 1 is a flow chart of a first embodiment of a parimutuel game in accordance with the present invention.

Referring to FIG. 1, the player has the option of selecting in block 10 "FAST" or "LAST." In this game, the player decides in block 12 whether the total of the starting numbers of the first four finishing animals or the last four finishing animals will equal closer to twenty-one (21). A minimum wager would be $2.00 (US). and can be placed in block 14. Parimutuel race operators retain a set percentage of all bets as determined by individual state law. After the bets are placed, the race is run in block 16.

For example, a player bets $2.00 on "BLACKJACK FAST". The race is run and the finishing order is 7-6-5-1-8-2-3-4. The total of the starting numbers of the first four animals or the "FAST" group is "19" (7+6+5+1). The total of the starting numbers of the last four animals or the "LAST" group is 17 (8+2+3+4). All players betting on the "FAST" group win, as shown in block 18. All players betting on the "LAST" group lose, as shown in block 20.

A total of over "twenty-one"(21), called a "bust", loses as shown in block 22. A total of "eighteen" (18) by either group is a tie, also called a "push". In the case of a push, the wagering pool carries over to the next race and is divided among the winners of that race, as shown in block 24.

(b) ROUF-LETTE

Figure 2:
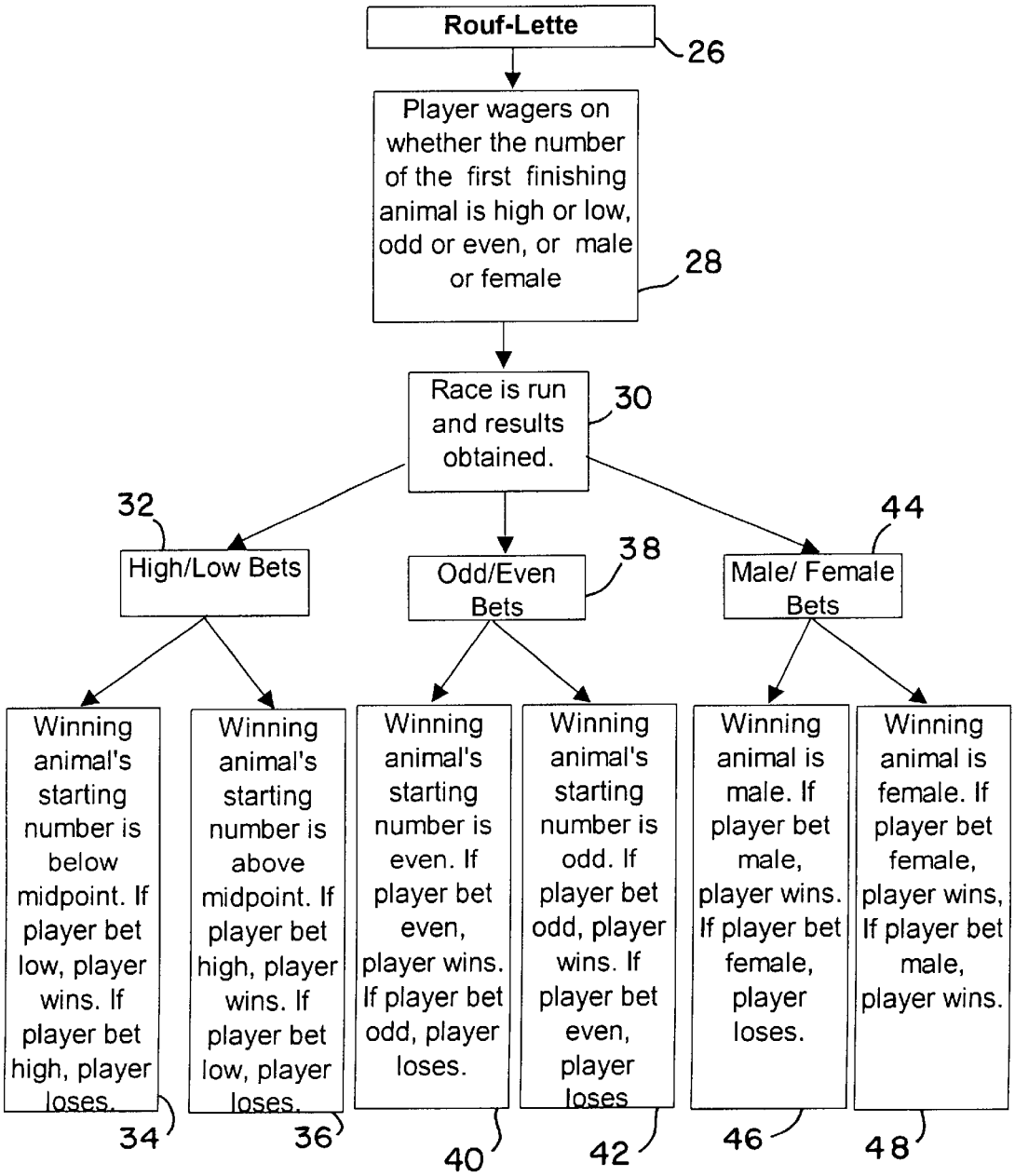
FIG. 2 is a flow chart of a second embodiment of a parimutuel game in accordance with the present invention.

Referring to FIG. 2, in the ROUF-LETTE game represented by block 26, players have the option to wager in block 28 upon whether the first place finishing animal's starting number is high or low (based on a midpoint of the number of animals running), as shown in block 32, odd or even, shown in block 38, or whether the first place finishing animal is male or female, shown in block 44. Compounded wagers combining these options will also be offered. A minimum wager would be $2.00 (US). Parimutuel race operators retain a set percentage of all bets as determined by individual state law. After the bets are placed, the race is run in block 30.

For example, player #1 wagers that the starting number of the first place finishing animal will be low. He makes another wager on even. He makes another wager that a male animal will win. Player #2 makes a compounded wager on low and even. Player #3 makes a compounded wager of low, even, and female. The race runs and finishes 2-5-6-3-1-8-7-4. The "2" animal finishes first and is male. Winning bets include low (as "2" is in the lower range from the midpoint), as shown in blocks 34 and 36, even (as "2" is an even number), as shown in blocks 40 and 42, and male (as the winning animal is a male), as shown in blocks 46 and 48.

Player #1 wins all three of his separate wagers on low, even, and male. Player #2 wins his compounded bet of low and even. He receives a higher pay-out than any one bet of Player #1 due to the longer odds of hitting both factors. Player #3 loses his compounded bet (low, even, female) as he missed the male or female portion of that bet.

(c) BASEBALL

Figure 3:
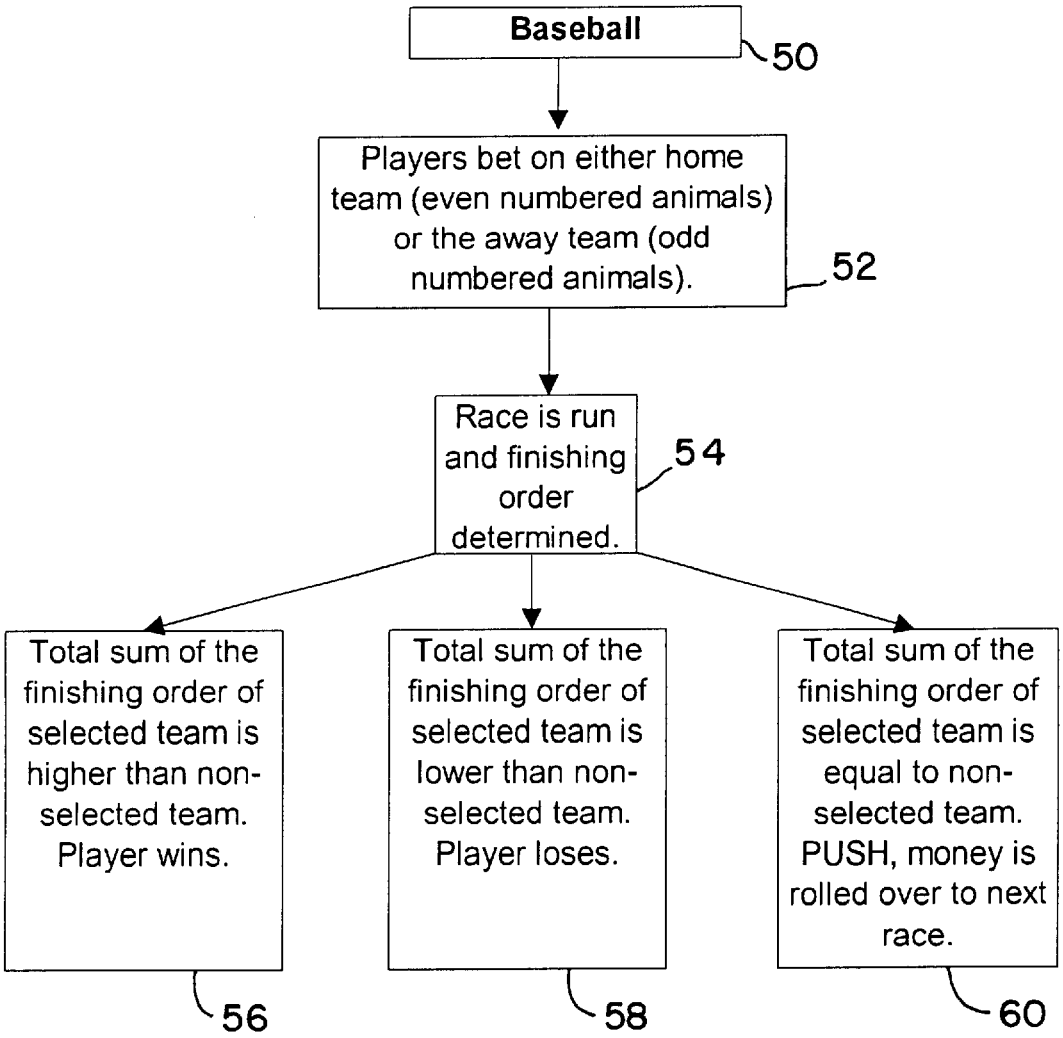
FIG. 3 is a flow chart of a third embodiment of a parimutuel game in accordance with the present invention.

Referring to FIG. 3, in the BASEBALL game represented by block 50, players bet on either the home team (even numbered animals) or the away team (odd numbered animals). The finishing position of each animal equals the number of "runs" scored by that animal. The team with the highest number of runs wins. Ties push and rollover to the next race. A minimum wager would be $2.00 (US). Parimutuel race operators retain a set percentage of all bets as determined by individual state law. After the bets are placed, the race is run in block 54.

For example, Player #1 bets on the home team. The race runs and finishes 3-5-4-1-2-7-6-8. The away team (odd numbered animals) scored a total of 13 runs with the "3" animal finishing first for one (1) run, the "5" animal finishing second for two (2) runs, the "1" animal finishing fourth for 4 runs, and the "7" 1 animal finishing sixth for six (6) runs ( 1+2+4+6=13 total runs). The home team (even numbered animals) scored a total of 23 runs with the "4" animal finishing third for three (3) runs, the "2" animal finishing fifth for five (5) runs, the "6" animal finishing seventh for seven (7) runs, and the "8" animal finishing eighth for eight (8) runs (3+5+7+8=23 total runs). As shown in blocks 56, 58 and 60, the home team and player #1 win.

(d) DOGGIE CRAPS or HORSIE CRAPS

Figure 4:
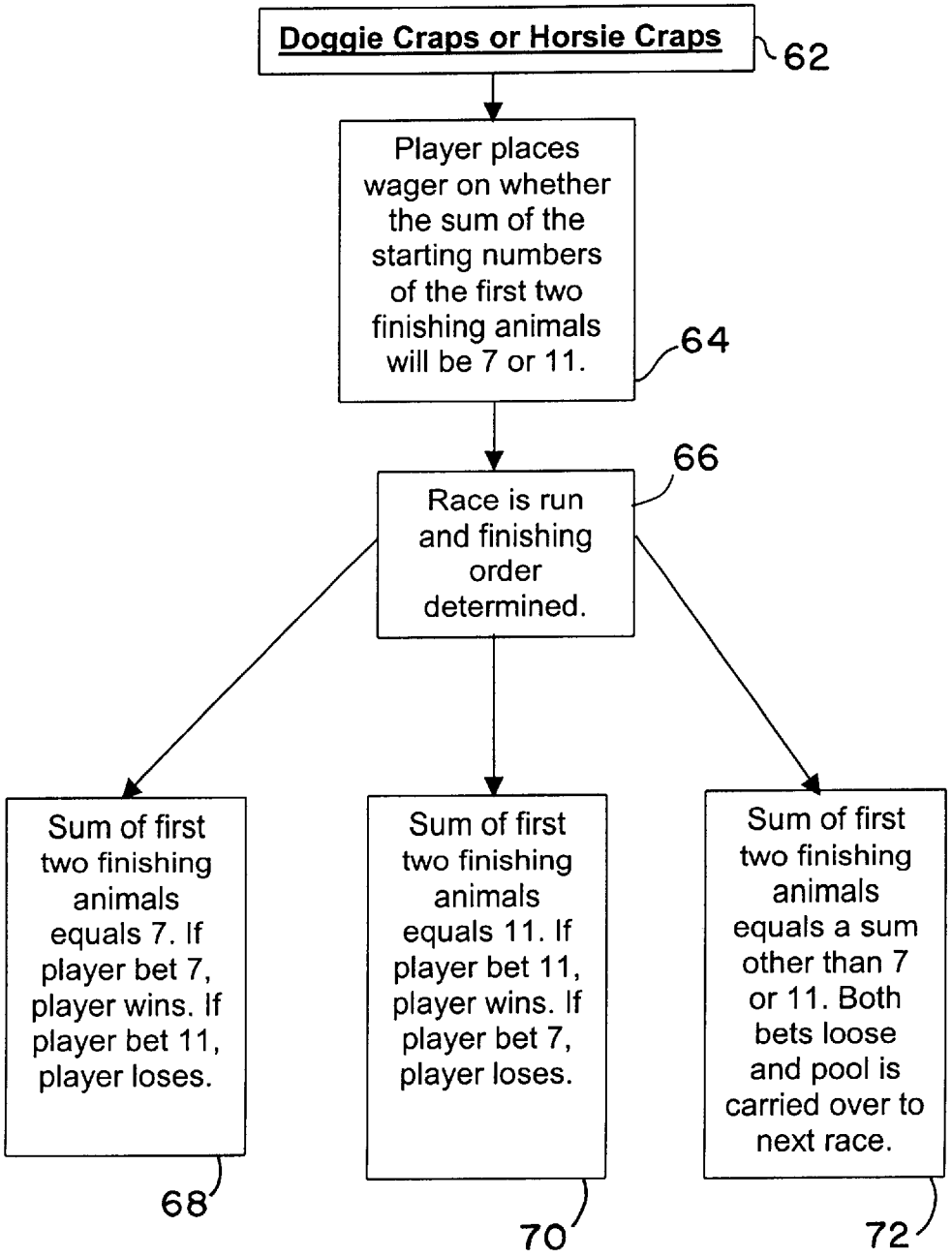
FIG. 4 is a flow chart of a fourth embodiment of a parimutuel game in accordance with the present invention.

Referring to FIG. 4, in the DOGGIE or HORSIE CRAPS game represented in block 62, players in block 64 choose either the number "7" or "11." After the race is run in block 66, winners are determined by the total of starting numbers of the first and second place finishing animals. If that total equals either "7" or "11," players holding tickets for that number win, as shown in block 68 and 70. If that total does not equal "7" or "11," the betting pool carries over to the next race as shown in block 72. This continues until "7" or "11" is reached exactly. A minimum wager would be $2.00 (US). Parimutuel race operators retain a set percentage of all bets as determined by individual state law.

For example, Player #1 bets on "7". Player # 2 bets on "11". The race is run and finishes 4-5-6-7-3-2-8-1. The total of the starting numbers of the first and second place animals is "9" (4+5). Both players lose as the total of the starting numbers of the first and second place animals does not equal either "7" or "11". The wagering pool carries over to the next race.

Player #1 bets again on "7". Player #2 bets again on "11". The next race is run and finishes 5-2-4-3-1-6-8-7. Player #1 and all bets on "7" win and split the wagering pool as the total of the starting numbers of the first and second place animals does equal "7" (5+2). Player #2 loses again with his "11".

Winning pairs for "7" for dogs and horses include: 1 and 6; 2 and 5; 3 and 4. Winning pairs for "11" for dogs include: 3 and 8; 4 and 7; 5 and 6. Winning pairs for "11" for horses include: 1 and 10; 2 and 9; 3 and 8; 4 and 7; 5 and 6. The difference in number of winning combinations for "11" between dog and horse racing is created by the fact a maximum of eight dogs are run in any given dog race while the number of horses in any given race can vary significantly.

All possible totals for pairs (winning and non-winning) of first and second place finishing animals with their number of all possible combinations in an eight animal race are:

(1) total of "3" with 1 combination (1+2);
(2) total of "4" with 1 combination (1+3);
(3) total of 5 with 2 combinations (1+4, 2+3)
(4) total of "6" with 2 combinations (1+5, 2+4)
(5) total of "7" with 3 combinations (1+6, 2+5, 3+4)
(6) total of "8" with 3 combinations (1+7, 2+6, 3+5)
(7) total of "9" with 4 comb. (1+8, 2+7, 3+6,4+5)
(8) total of "10" with 3 combinations (2+8, 3+7, 4+6)
(9) total of "11" with 3 combinations (3+8, 4+7, 5+6)
(10) total of "12" with 2 combinations (4+8, 5+7)
(11) total of "13" with 2 combinations (5+8, 6+7)
(12) total of "14" with 1 combination (6+8)
(13) total of "15" with 1 combination (7+8)

Therefore, 13 pair totals exist with 28 possible combinations in an eight animal race. Two winning pair totals ("7" and "11") with 6 winning combinations exist in that same eight animal race. A player has a ten point seventy one percent (10.71%) chance of winning if only "7" or "11" are played. A player has a twenty one point forty nine percent (21.49%) chance of winning if both "7" and "11" are played.

(e) POWERDOG or POWERSTEED

Figure 5:
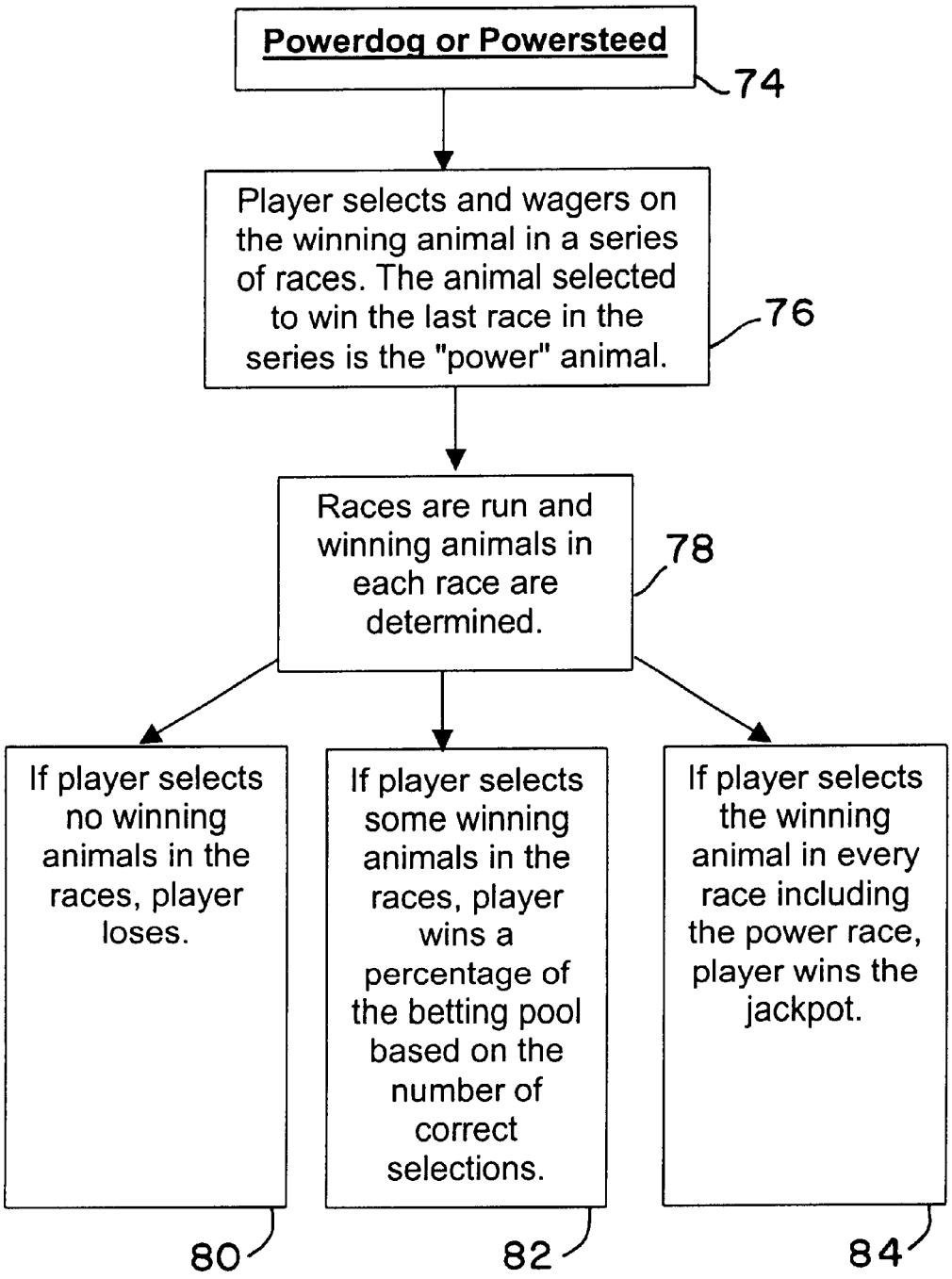
FIG. 5 is a flow chart of a fifth embodiment of a parimutuel game in accordance with the present invention.

Referring to FIG. 5, the POWERDOG or POWERSTEED game is represented by block 74. In this game, players attempt to choose the winning animal in the last several races of a racing program that comprise the POWERDOG/POWERSTEED bracket, as shown in block 76. The winning animal in the last race is the POWERDOG or POWERSTEED. After the races are run in block 78, the playouts for the wagers are determined. As shown in blocks 80, 82 and 84, payouts increase with the number of correct selections within the bracket by the player. Payouts increase further If the correct animal is selected as the POWERDOG or POWERSTEED. Any player correctly selecting all winners in the bracket wins or splits the jackpot with multiple winners also selecting all winners. If no player correctly selects all the winners, the remaining amount in the betting pool after paying lesser winners carries over to the next day's racing program. Parimutuel race operators retain a set percentage of all bets as determined by individual state law.

(1) The inventors recommend the following structure for payout levels:
  (a) A set percentage of the betting pool is reserved for daily payouts. Winners in the bracket of races comprising POWERDOG/POWERSTEED are paid a set percentage of the reserved daily payout pool. Level of payout is determined by the number of correct selections;
  (b) An additional percentage will be allocated for extra pay for correct selections in the POWERDOG/POWERSTEED races in combination with other winning selections;
  (c) A set percentage of the betting pool is reserved as a jackpot. Only players selecting all winners in the bracket divide the jackpot. If no one selects all the winners in the bracket, that set percentage carries over to the next program or race night. That amount is the starting point for the next program's POWERDOG pool;
  (d) The levels of those percentages will be determined by each individual parimutuel race operator;
  (e) Example pay structure: The parimutuel race operator has determined that forty percent (40%) of the POWERDOG betting pool will be reserved for daily payouts. Sixty percent (60%) is allocated to the jackpot reserved betting pool. Payout percentages from the daily reserved pool are as follows:

| | |
|---|---|
| 1 win = 3% | 1 win & POWERDOG = 8% |
| 2 wins = 6% | 2 wins & POWERDOG = 11% |
| 3 wins = 9% | 3 wins & POWERDOG = 14% |
| 4 wins = 12% | 4 wins & POWERDOG = 17% |
| 5 wins = 20% | |

If no winners exist in a specific category, those funds for that category will carry over into the next program's POWERDOG betting pool.

5 wins & POWERDOG=JACKPOT (60% of pool)

If no winners exist in the jackpot category, the amount carries over to begin the next program's POWERDOG betting pool.

(2) Example of play:

Player #1 bets:
"1" in race 10;
"2" in race 11;
"3" in race 12;
"4" in race 13;
"5" in race 14;
"6" as the POWERDOG in the final event or race 15.

The races are run and first place finishing dogs are as follows:
"1" in race 10;
"3" in race 11;
"8" in race 12;
"4" in race 13;
"7" in race 14;
"6" in race 15 or POWERDOG race.

Player #1 has selected three winners ("1" in race 10, "4" in race 13, and "6" in race 15 or the POWERDOG race).

Player #1 has won two races and the POWERDOG race. No one hit all the races to win the jackpot. The parimutuel race operator takes its percentage as determined by individual state law. Twenty thousand dollars ($20,000 US) remains in the POWERDOG betting pool. Sixty percent (60%) or twelve thousand dollars ($12,000 US) is placed in the jackpot pool. Forty percent (40%) or eight thousand dollars ($8000 US) is placed in the daily payout pool.

With his two wins and the POWERDOG win, according to the example pay structure player #1 splits eleven percent (11%) of eight thousand dollars, equaling eight hundred and eighty dollars ($880.00 US), between 10 other winners (11 total) in his category. Player #1 wins eighty dollars ($80.00 US). Because no one hit the jackpot by selecting all the winners, twelve thousand dollars ($12,000 US) carries over from the jackpot pool to the next program's POWERDOG pool.

CONCLUSION, RAMIFICATIONS, AND SCOPE OF INVENTION

In conclusion, the reader will see that the invention package games provide new methods of wagering for parimutuel race operators to combat fierce competition from casinos and lotteries. Our games accomplish this by giving the public familiar methods to enjoy parimutuel race wagering. Our games do not require expertise in dog or horse selection and will encourage repeat business especially from novices. Our games provide new applications of popular and ancient games to an industry handicapped by its own complicated games and wagers. Our games function on unique interpretations of current parimutuel race results. Our invention will be hugely profitable for parimutuel race operators and players throughout the country.

While our above description contains many specificities, these should not be construed as limitations on the scope of the invention, but rather as an exemplification of one preferred embodiment thereof. For example, additional games employing new applications of popular games to parimutuel race wagering can be included with the invention package games for licensing determined by their workability; variations to each game can be added to increase and/or decrease odds and/or payouts; the games can be applied to other forms of racing when wagering becomes available.

Accordingly, the scope of the invention should be determined not by the embodiments described, but by the appended claims and their legal equivalents.

We claim:

1. A method of wagering on pari-mutual race having a predetermined number of participants, each participant having a corresponding numerical indicia assigned thereto, comprising the steps of:

selecting at least two numbers prior to the race which correspond to the participants therein and providing same as selected positions;

determining an order of finish of the participants after the race;

combining the numerical indicia of the participants which finish the race in the selected positions and providing the same as a first combination; and comparing the first combination of numerical indicia to a preselected number independent of the order of finish in the race.

2. The method of claim 1 further comprising the additional steps of placing a wager prior to the race and paying off on the wager in response to the first combination being equal to the preselected number.

3. The method of claim 1 further comprising the additional steps of placing a wager prior to the race and paying off on the wager in response to the first combination being less than the preselected number.

4. The method of claim 1 further comprising the additional step of selecting the preselected number from a group consisting of 7, 11 and 21.

5. The method of claim 1 further comprising the additional steps of:

selecting at least two numbers prior to the race which correspond to the participants therein and providing same as second selected positions;

combining the numerical indicia of the participants which finish the race in the second selected positions and providing the same as a second combination; and comparing the second combination of numerical indicia to the first combination of numerical indicia and to the preselected number such that the combination of numbers closest to the preselected number is provided as the winning combination.

6. The method of claim 1 wherein the selected positions include 1 and 2.

7. A method of wagering on pari-mutuel race having a predetermined number of participants, each participant having a corresponding numerical indicia assigned thereto, comprising the steps of:

selecting two numbers prior to the race which correspond to positions of two of the participants upon completion of the race and providing same as selected positions;

determining an order of finish of the participants upon completion of the race;

adding the numerical indicias of the participants which finish the race in the selected positions and providing the same as a sum; and comparing the sum to a preselected number, the preselected number selected independent of the order of finish of the race.

8. The method of claim 7 comprising the additional step of selecting a third number prior to the race, the third number corresponding to a position of one the participants upon completion of the race and providing same as one of the selected positions.

9. The method of claim 7 comprising the additional steps of placing a wager prior to the race on the selected positions and receiving a payout if the sum equals the preselected number.

10. The method of claim 7 further comprising the additional steps of:

selecting a second two numbers prior to the race which correspond to the positions of two of the participants upon completion of the race and providing same as second selected positions;

adding the numerical indicias of the participants which finish the race in the second selected positions and providing the same as a second sum; and comparing the second sum to the first sum and to the preselected number.

11. The method of claim 10 further comprising the additional steps of placing a wager prior to the race on the selected positions and receiving a payout if the first sum is closer than the second sum to the preselected number.

12. The method of claim 7 further comprising the additional steps of placing a wager prior to the race on the selected positions and receiving a payout on the wager in response to the sum being less than the preselected number.

13. The method of claim 7 further comprising the additional step of selecting the preselected number from a group consisting of 7, 11 and 21.

14. The method of claim 7 wherein the selected positions are 1 and 2.

15. The method of claim 7 further comprising the additional steps of placing a wager prior to the race on the selected positions and losing the wager if the first sum differs from the preselected number.

16. A method of wagering on pari-mutuel race having a predetermined number of participants, each participant sequentially numbered with numerical indicia, comprising the steps of:

providing a plurality of players, each player selecting two positions prior to the race which correspond to possible positions of the participants upon completion of the race and placing a wager thereon;

determining an order of finish of the participants upon completion of the race;

adding the numerical indicia of the participants which finish the race in the selected positions for each player and providing the same as a player sum; and comparing each player sum to a preselected number, the preselected number being independent of the order of finish of the race.

17. The method of claim 16 comprising the additional step of each player selecting a third position prior to the race corresponding to a position of one the participants upon completion of the race and placing a wager thereon.

18. The method of claim 16 comprising the additional step of distributing a payout to a player if the player sum of the player equals the preselected number.

19. The method of claim 16 further comprising the additional step of distributing a payout to a player if the player sum of the player is less than the preselected number.

20. The method of claim 16 further comprising the additional step of distributing a payout to a player if the player sum of the player is closest to the preselected number.

* * * * *